US005803348A

United States Patent [19]

Verhelle

[11] Patent Number: 5,803,348

[45] Date of Patent: Sep. 8, 1998

[54] DISPLAY CONTAINERS

[75] Inventor: Christian Daniel Verhelle, Mechelen, Belgium

[73] Assignee: The Procter & Gamble Company, Cincinnati, Ohio

[21] Appl. No.: 817,153

[22] PCT Filed: Oct. 12, 1995

[86] PCT No.: PCT/US95/13451

§ 371 Date: Apr. 11, 1997

§ 102(e) Date: Apr. 11, 1997

[87] PCT Pub. No.: WO96/11849

PCT Pub. Date: Apr. 25, 1996

[30] Foreign Application Priority Data

Oct. 13, 1994 [EP] European Pat. Off. ..... 948701600

[51] Int. Cl.[6] ..... B65D 5/66

[52] U.S. Cl. ..... 229/125.08; 229/23 BT; 229/123.3; 229/125.32

[58] Field of Search ..... 229/23 R, 23 BT, 229/123.3, 125.08, 125.32, 125.33, 211, 221, 224

[56] References Cited

U.S. PATENT DOCUMENTS

| | | | |
|---|---|---|---|
| 2,364,829 | 12/1944 | Tichenor | 229/125.08 |
| 3,019,959 | 2/1962 | Skowronski | 229/224 |
| 3,276,662 | 10/1966 | Farquhar | 229/23 BT |
| 3,372,794 | 3/1968 | Kohlhaas . | |
| 3,870,222 | 3/1975 | Butler | 229/23 R |
| 3,917,158 | 11/1975 | Dorofachuk et al. . | |
| 3,944,127 | 3/1976 | Bruke et al. | 229/125.08 |
| 4,083,455 | 4/1978 | Keating, Jr. | 229/224 |
| 4,339,068 | 7/1982 | Brauner | 229/23 BT |
| 4,477,015 | 10/1984 | Lozaun | 229/23 R |
| 4,502,514 | 3/1985 | Ballard et al. | 141/1 |
| 4,553,666 | 11/1985 | Gullikson . | |
| 4,801,077 | 1/1989 | Sweatt, III et al. | 229/113 |
| 4,848,651 | 7/1989 | Hartness | 229/125.33 |
| 5,373,960 | 12/1994 | Gunn et al. | 220/416 |
| 5,447,225 | 9/1995 | Gunn et al. | 229/125.32 |

FOREIGN PATENT DOCUMENTS

| | | | |
|---|---|---|---|
| 1346391 | 11/1963 | France | 229/125.08 |
| 95473 | 9/1960 | Netherlands | 229/125.08 |

*Primary Examiner*—Gary E. Elkins
*Attorney, Agent, or Firm*—Jack L. Oney, Jr.; William Scott Andes

[57] ABSTRACT

A display container comprises a tray and a hood. The tray and the hood are permanently fastened only in a portion delimited by a line of weakness. The hood can be conveniently removed by a single movement of the hand.

12 Claims, 4 Drawing Sheets

THE CONTAINER (1)

LEGEND: TRAY

PERMANENTLY FASTENED PORTION

OPENING PROCEDURE

LEGEND: LINE OF WEAKNESS

PERMANENTLY FASTENED PORTION

DISPLAY CONTAINERS

TECHNICAL FIELD

The present invention relates to display containers. The container according to the present invention comprises a hood and a tray which are detachable from one another.

BACKGROUND

The present invention is a container intended to ease the problem of transferring consumer goods from the production facility to the shelves of the distribution outlets. Prior to this invention, the employees of distribution outlets normally had to take goods out of containers and manually place said goods onto the shelves so as to display them for the consumers. This was a rather lengthy and impractical process because each container had to be cut opened and the housed goods had to be taken out through the top of the container one by one. Said goods were hard to get out of the containers, especially when they were relatively heavy (2, 3 or more kilograms). Considering the number of containers that are usually involved in medium or large size distribution outlets, opening boxes and emptying them from the housed goods often amounted to extenuating work.

To deal with this problem, several so-called display containers have since been designed. Such containers generally comprise an inferior part usually referred to as the tray and a superior part usually referred to as the hood.

For instance, patent DE 39 40 872 A1 refers to a container with an easier opening mechanism.

Accordingly, glue points between the tray and the hood are located on flaps placed on the side of the container which can be grabbed and pulled to separate the tray and the hood. The hood is then removed to leave the tray exhibiting all housed goods. A problem with the containers in DE 30 40 872 A1 is that the opening procedure remains rather complex since one has to first open the flaps before removing the hood. The opening process of DE 39 40 872 A1 requires several steps and thus remains complicated. As one opens a single container, the fact that the opening process takes a few steps may seem irrelevant. However, when the number of containers to open escalates, a complicated opening process becomes a major problem. None of the cases of the prior art combine an single step opening process with full accessibility and maximum solidity during transportation and handling of the container. The present invention provides a display container with a single-step opening mechanism which does not undermine the solidity of the container and allows full accessibility.

In the present invention, the hood is removed from the tray by one hand movement. Once the hood is removed, the lower tray still containing the housed goods can be placed on the shelves of distribution outlets. This quicker and simpler opening process can drastically ease the employees' daily workload.

SUMMARY OF THE INVENTION

A container (1) having a top wall (2), a bottom wall (3), side walls (4;4'), a front wall (5) and a back wall (6) said container comprising a tray (7) and a hood (8) which overlap partly, characterized in that said hood is permanently fastened to said tray only in a portion (9) of said tray which consists of the whole of said front wall of said tray and, optionally, a part of said side walls of said tray connected to said front wall, said portion being delimited from the remainder of said tray by a line of weakness (10)

BRIEF DESCRIPTION

DETAILED DESCRIPTION OF THE INVENTION

Figure 1:
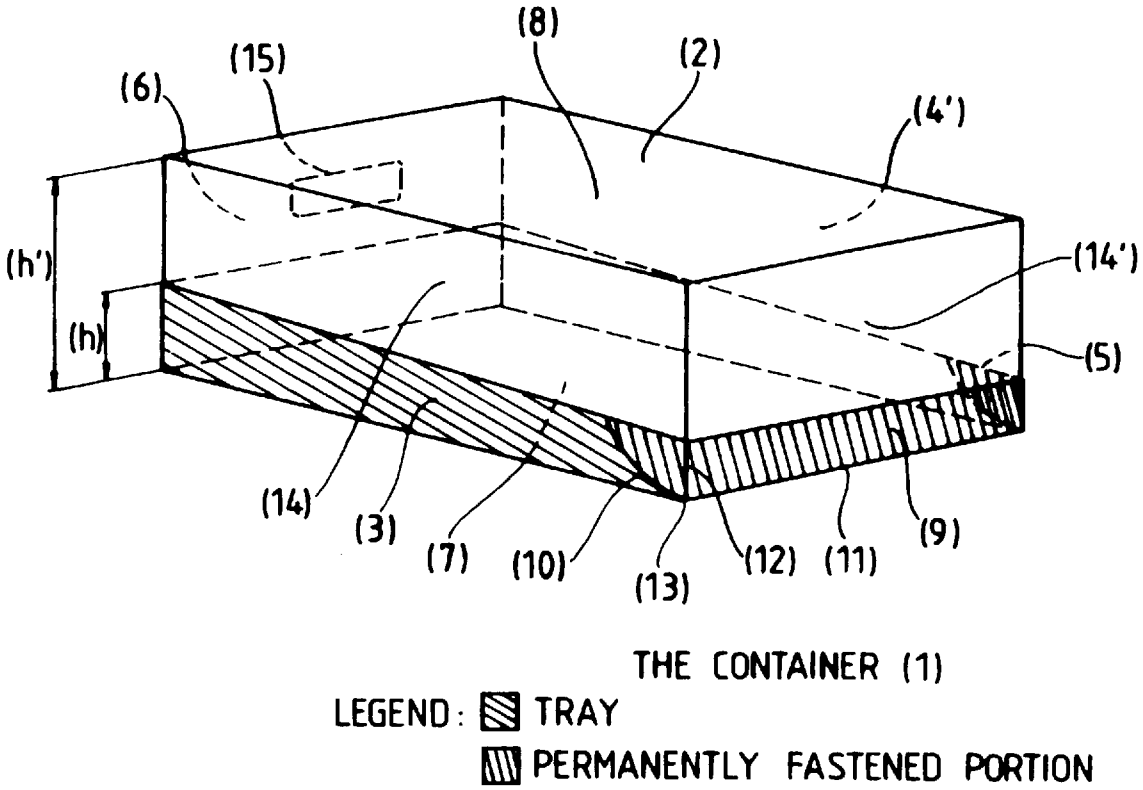
FIG. 1 is a perspective view of the container of the present invention.
Figure 2:
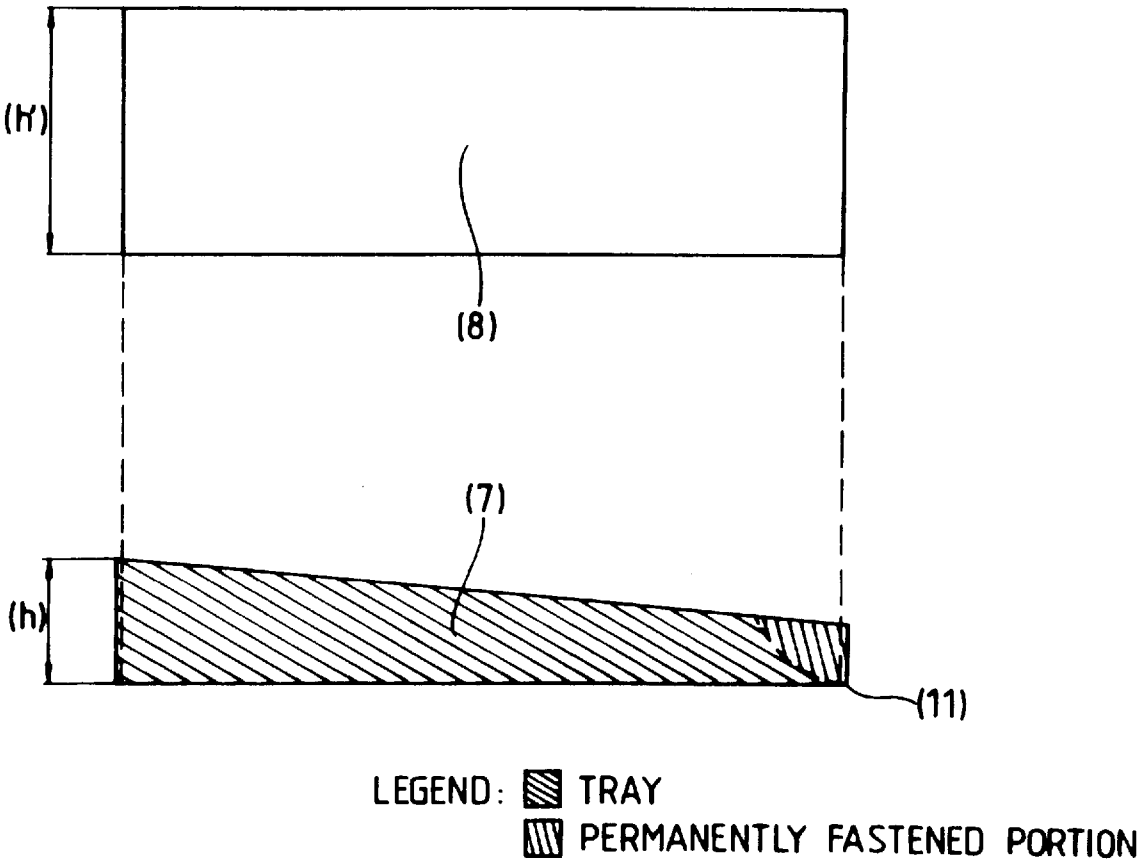
FIG. 2 is a side view of the hood and the tray of the container of the present invention.

The container (1) of the present invention comprises a tray (7) and a hood (8). Although this is not a limitation of the present invention, it is generally preferred that both the tray and the hood be made of cardboard, or cardboard-containing material. The tray is the bottom part, in which are placed the goods to be housed by the container. The tray therefore provides the bottom wall (3) of the container. The hood is the top part, which provides a cover for the tray and the housed goods. The hood therefore provides the top wall (2) of the container. It is essential that the hood and the tray should overlap partially, and therefore both the tray and the hood provide the front (5), back (6) and side walls (4;4') of the container.

In the container of the present invention, the hood can be inserted in the tray, or the hood may cover the tray. For the overall solidity of the container, it is preferred that the hood should be inserted in the tray rather than the inverse. The height (h) of the tray should be as small as possible, since a high tray would otherwise compromise display of and access to the housed goods, once the hood is removed. Therefore, in a preferred embodiment herein, the maximum height of the tray is smaller than the maximum height (h') of the hood.

Figure 6:
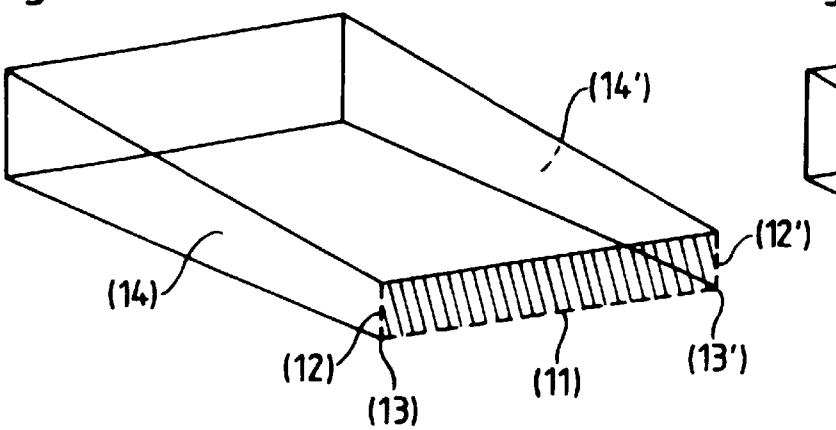

An essential characteristic of the container of the present invention is that the hood and the tray are fastened together in a permanent manner in a selected portion (9) only. Said portion of the tray consists of the whole of the front wall of the tray and, optionally, a part of the side walls of the tray connected to the front wall. Said portion is delimited from the remainder of the tray by a line of weakness (10). Since said portion must comprise the whole of the front wall of said tray, said line of weakness must pass through the whole length of the edge (11) where the front wall and the bottom wall meet. In the simplest embodiment of the present invention shown in FIG. 6, said portion does not comprise a part of said side walls. In this embodiment, said line of weakness further passes through the whole of the edge (12) where said front wall and said side walls meet.

Figure 5:
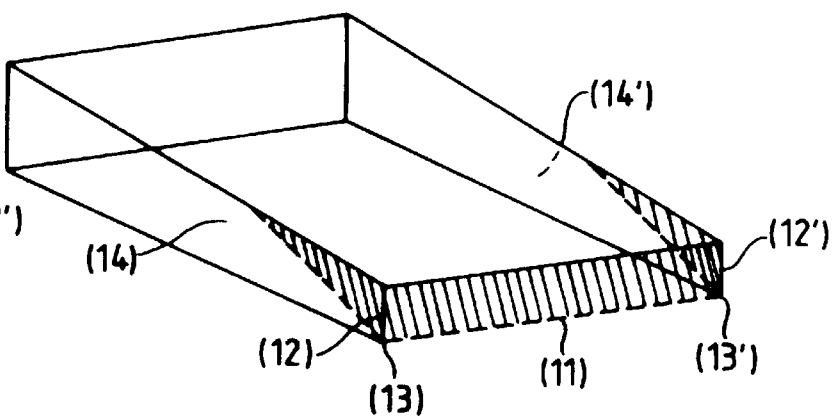
Figure 4:
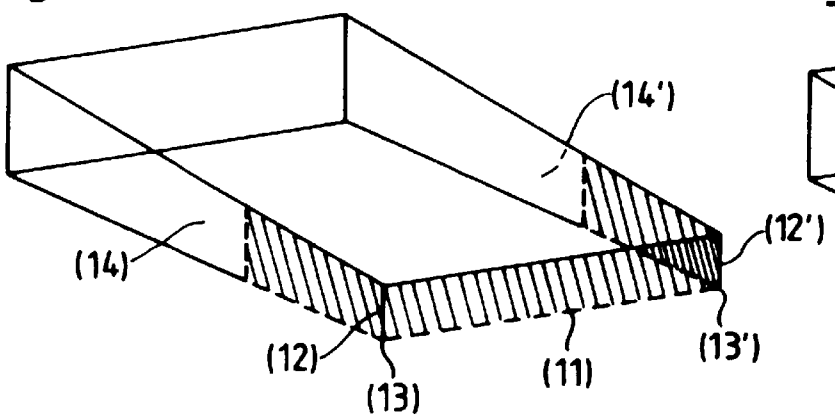
FIG. 4, 5, 6, 7 show trays with various possible portions.
Figure 7:
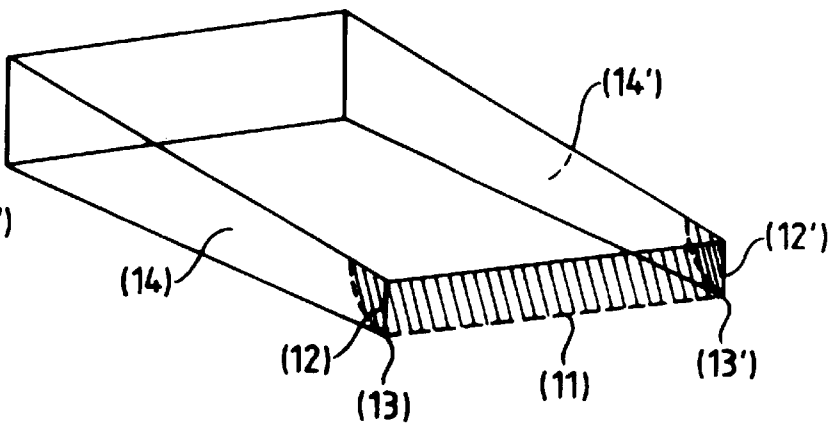

However, in preferred embodiments of the present invention shown in FIGS. 4,5 and 7, which ensure a cleaner separation of hood and tray, and a better display of and access to the goods housed in the container, said portion further comprises a part of the side walls. In these embodiments, the line of weakness passes through said edge (12) and through the corners (13, 13') where said bottom, front and side walls (14,14') meet, and on said side wall up to the upper edges of the side walls of the tray. In a yet more preferred embodiment of the present invention shown in FIGS. 5 and 7, where said portion comprises a part of side walls, said line of weakness is oblique on said side walls, most preferably arc-shaped as in FIG. 7.

Although this is not a limitation, the line of weakness can be obtained with the help of a laser, acid or any other physical or chemical or mechanical means known to the man skilled in the art to achieve a weakening of the material of the container in a designated area. Said line of weakness can be a pre-perforated line or any other mechanical or chemical weakening which allows rupture in the targeted area. For instance, said line of weakness can achieve the complete or partial perforation of the material that makes-up the container. Although this is not a limitation, the various means of perforation known to the man in the art can be applied to achieve the removal of the outer liner, inner liner or both inner and outer liners of said material of the container as a means to create a line of weakness.

In these preferred embodiments of the present invention where said portion of the container comprises a part of the side walls, it is preferable that the length of the portion is less than one half, more preferably less than one third and most preferably less than one fourth of the total length of the side walls. Indeed, this embodiment of the container makes the best compromise between ease of open, benefiting from a lever action, and convenient display and access, benefiting from a large removed portion, after opening.

It is essential that said tray and said hood be fastened together permanently in said portion only. Said permanent fastening can be achieved by a variety of means available to the man skilled in the art, and include gluing, or any other physical connections. By "permanent", it is meant herein a fastening resistant to the opening of the container, whereby said hood and said tray remain fastened in said portion as said hood is removed. Consequently, a "permanent" fastening herein, is a fastening which is stronger than the line of weakness.

To increase the container's resistance to shocks during handling, it is preferable that the tray and the hood be further fastened together in a non-permanent manner on other portions than said permanently fastened portion. As used herein, a non-permanent fastening is a fastening which breaks as the hood is removed, whereby the fastening is as strong or weaker than the line of weakness. Preferably, said non-permanent fastening is located on the side and/or back walls. Again, various means are available to the man skilled in the art to achieve such non-permanent fastening. For instance, small glue points may placed on the back or side walls of the hood may be used as a non-permanent fastening. Also, a piece of the tray cut on three sides and hinged to the tray on the fourth side can be tucked through an opening in the wall of the hood in the back of the container. This flap used as a non-permanent fastening ensures that hood and tray are held together during handling and transportation.

Figure 3:
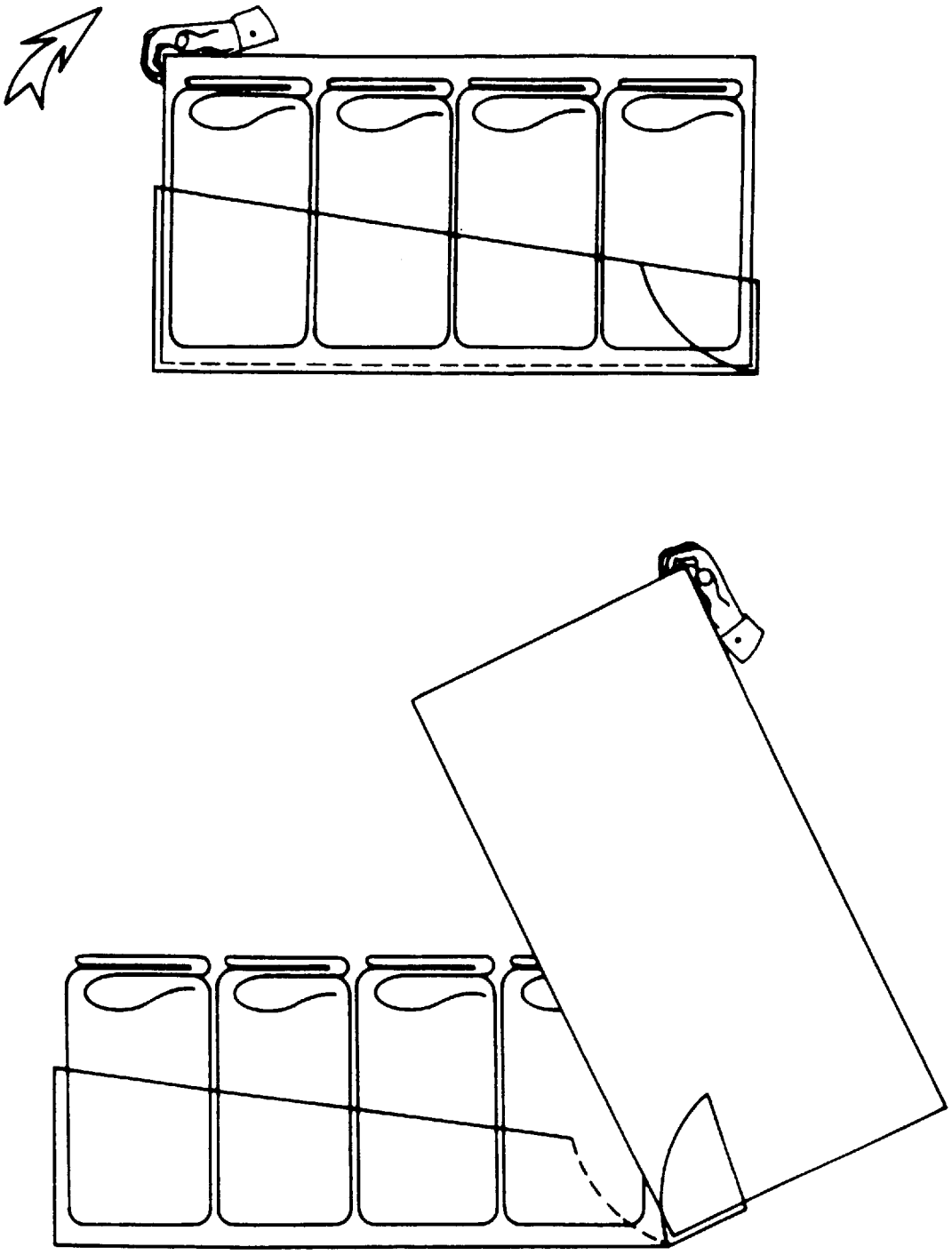
FIG. 3 shows the removal of the hood of the container of the present invention.

As shown in FIG. 3, the container of the present invention is opened in a single operation where the hood is grabbed about its back wall and swung towards the front of the container. As the hood is swung frontward, it forces said line of weakness to rupture, thereby releasing the permanently fastened portion from the tray. A tray is thus obtained which has no front portion, and, in some embodiments, reduced side walls, allowing a most convenient display and full access to the housed goods. As the hood is swung all optional non-permanent fastening points are also broken. The opening procedure is thus easy and quick because the structure of the container is so as to minimize the effort necessary to remove the hood In a preferred embodiment of the present invention, said hood comprises gripping means (15) located generally opposite said permanently fastened portion, for instance on the top wall or, preferably on the back wall. Said means can consist of a finger-trap, or a handle or grip.

The container of the present invention is intended to house a plurality of packaged goods. Such goods typically include bottles, cans, pure packs, pouches, sachets, bags, boxes and the like. Once the hood and tray have been separated in the manner described above and the tray is placed on the shelves of distribution outlets, customers can clearly see the goods and have access to them.

I claim:

1. A container (1) having a top wall (2), a bottom wall (3), side walls (4;4'), a front wall (5) and a back wall (6), said container comprising a tray (7) and a hood (8) which overlap partly, wherein said hood is permanently fastened to said tray only in a portion (9) of said tray which consists of the whole of said front wall of said tray and, optionally, a part of said side walls of said tray connected to said front wall, said portion being delimited from the remainder of said tray by a line of weakness (10).

2. A container according to claim 1, wherein said line of weakness on said side wall is generally oblique.

3. A container according to claim 2, wherein said line of weakness on said side wall is in the shape of an arc which passes by the bottom corner of said side wall, said front wall and said bottom wall.

4. A container according to claim 1, wherein said portion in said side walls is less than ½, of the length of said side wall.

5. A container according to claim 1, wherein said tray and said hood are fastened in a non-permanent manner at other portions than said permanently fastened portion.

6. A container according to claim 1, wherein said hood is inserted in said tray.

7. A container according to claim 6, wherein said hood rests on said bottom wall of said tray.

8. A container according to claim 1, wherein said back wall of said hood comprises gripping means (15).

9. A container according to claim 1, housing a plurality of goods.

10. A container according to claim 4, wherein said portion in said side walls is less than ⅓ of the length of said side wall.

11. A container according to claim 10, wherein said portion in said side walls is less than ¼ of the length of said side wall.

12. A container according to claim 9, housing a plurality of identical goods.

* * * * *